US007216776B2

(12) United States Patent
Gelardi

(10) Patent No.: US 7,216,776 B2
(45) Date of Patent: May 15, 2007

(54) CHILD-RESISTANT PILL DISPENSER

(75) Inventor: John A. Gelardi, Kennebunkport, ME (US)

(73) Assignee: Meadwestvaco Corporation, Stamford, CT (US)

( * ) Notice: Subject to any disclaimer, the term of this patent is extended or adjusted under 35 U.S.C. 154(b) by 0 days.

(21) Appl. No.: 11/083,270

(22) Filed: Mar. 17, 2005

(65) Prior Publication Data

US 2005/0205598 A1 Sep. 22, 2005

Related U.S. Application Data

(63) Continuation of application No. PCT/US03/29237, filed on Sep. 19, 2003.

(60) Provisional application No. 60/412,512, filed on Sep. 20, 2002.

(51) Int. Cl.
*G07F 11/16* (2006.01)

(52) U.S. Cl. ..... 221/256; 221/255; 221/268; 221/272

(58) Field of Classification Search ..... 221/27, 221/191, 255, 266, 268, 263, 247, 261, 248, 221/277, 267, 256, 257, 265, 264
See application file for complete search history.

(56) References Cited

U.S. PATENT DOCUMENTS

| | | | | |
|---|---|---|---|---|
| 3,276,636 A | * | 10/1966 | Johnson, Jr. | 222/368 |
| 3,318,491 A | * | 5/1967 | Williamson | 222/363 |
| 3,929,256 A | * | 12/1975 | Solomon | 221/81 |
| 4,522,313 A | | 6/1985 | Jennings et al. | |
| 4,828,143 A | | 5/1989 | Jennings | |
| 6,095,364 A | | 8/2000 | Dickie et al. | |
| 6,112,942 A | * | 9/2000 | Deacon | 221/266 |

FOREIGN PATENT DOCUMENTS

| | | | |
|---|---|---|---|
| CH | 380300 | * | 7/1964 |
| DE | 24 17 719 | | 11/1998 |
| FR | 1.128.646 | | 1/1957 |
| JP | 10-297683 | | 4/1997 |
| JP | 11079262 | * | 3/1999 |
| JP | 11-208746 | | 8/1999 |
| WO | WO 2004/026728 | | 4/2004 |

OTHER PUBLICATIONS

International Search Report for PCT/US03/29237.

* cited by examiner

*Primary Examiner*—Gene O. Crawford
*Assistant Examiner*—Timothy Waggoner
(74) *Attorney, Agent, or Firm*—Alexandra B. Urban, Esq.; Parks Knowlton LLC; Paul E. Knowlton, Esq.

(57) ABSTRACT

A child-resistant dispenser for dispensing items, including a chassis (12) having a reservoir (40) for holding items (16) and a conveyor (14) including a conveyor pocket (18) for receiving an item (16*a*). The conveyor (14) is pivotably mounted within chassis (12) between a closed position in which the conveyor pocket (18) is inaccessible from outside the dispenser (10), and an open position, in which the conveyor pocket (18) is accessible from outside of the dispenser (10). The dispenser further includes a pathway positioned between the reservoir (40) and the conveyor pocket (18) when the conveyor (14) is closed. The pathway is blocked by the conveyor (14) when the conveyor (14) is open. A locking mechanism (20, 22) is provided for releasably locking the pill conveyor (14) in a closed position. A user must simultaneously apply pressure to both the conveyor (14) and the locking mechanism (20, 22) in order to open the conveyor (14).

27 Claims, 6 Drawing Sheets

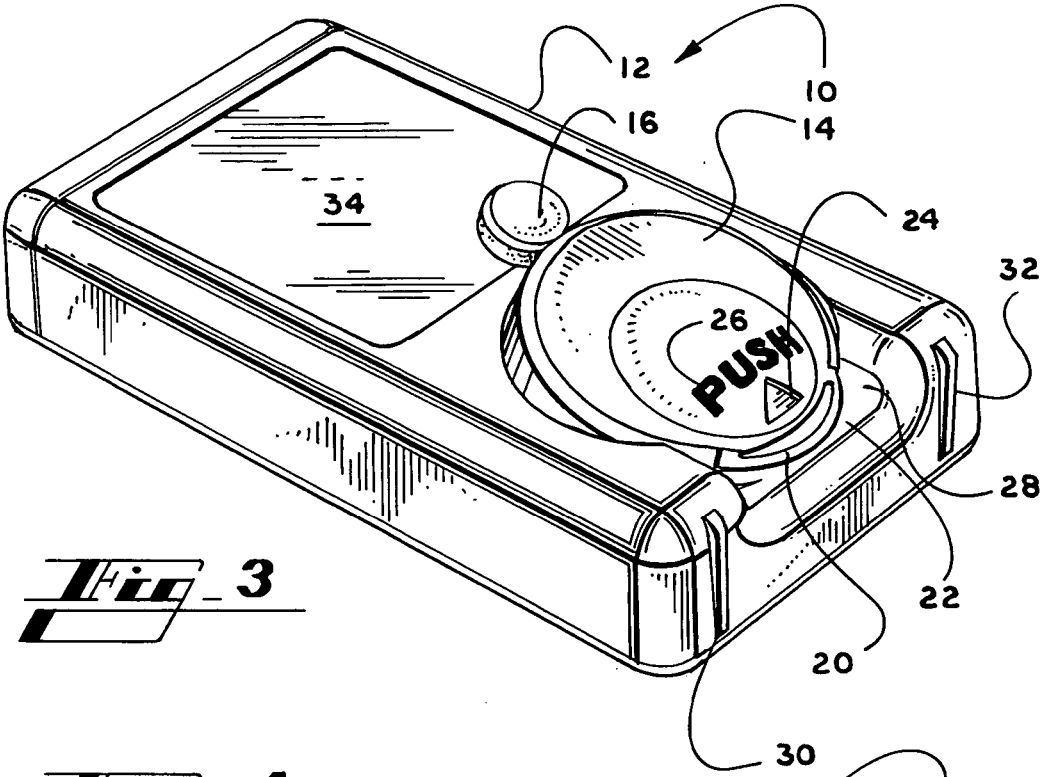
Fig. 3
Fig. 4
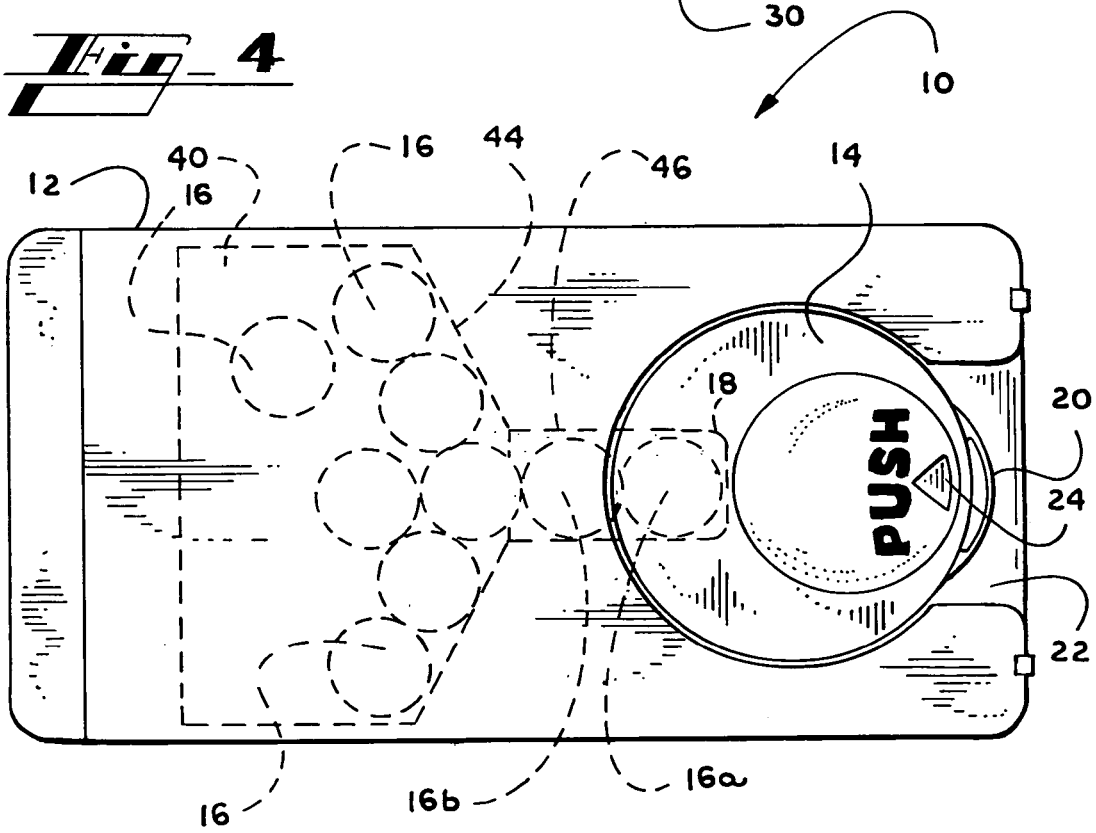

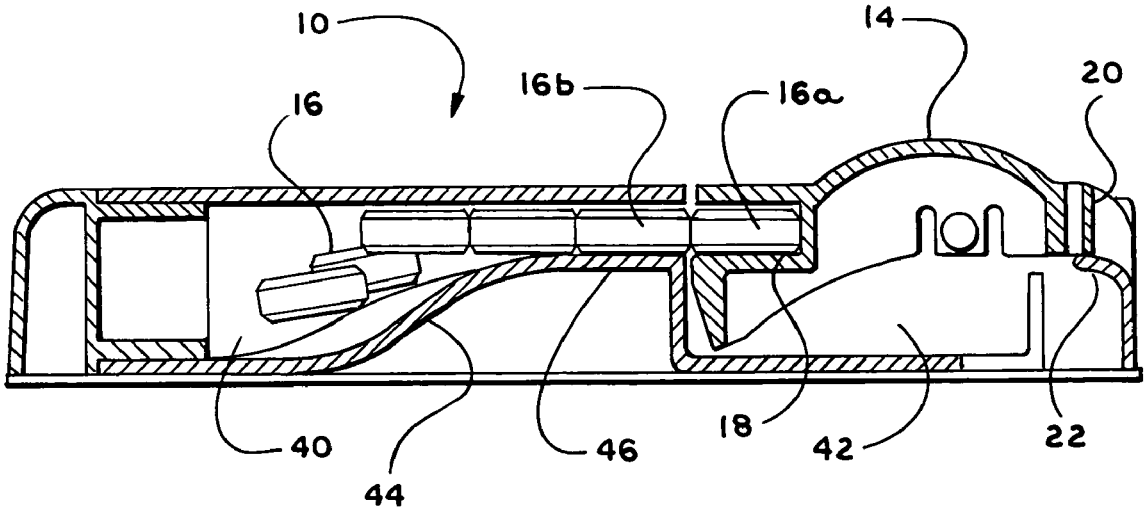
Fig_5
Fig_6
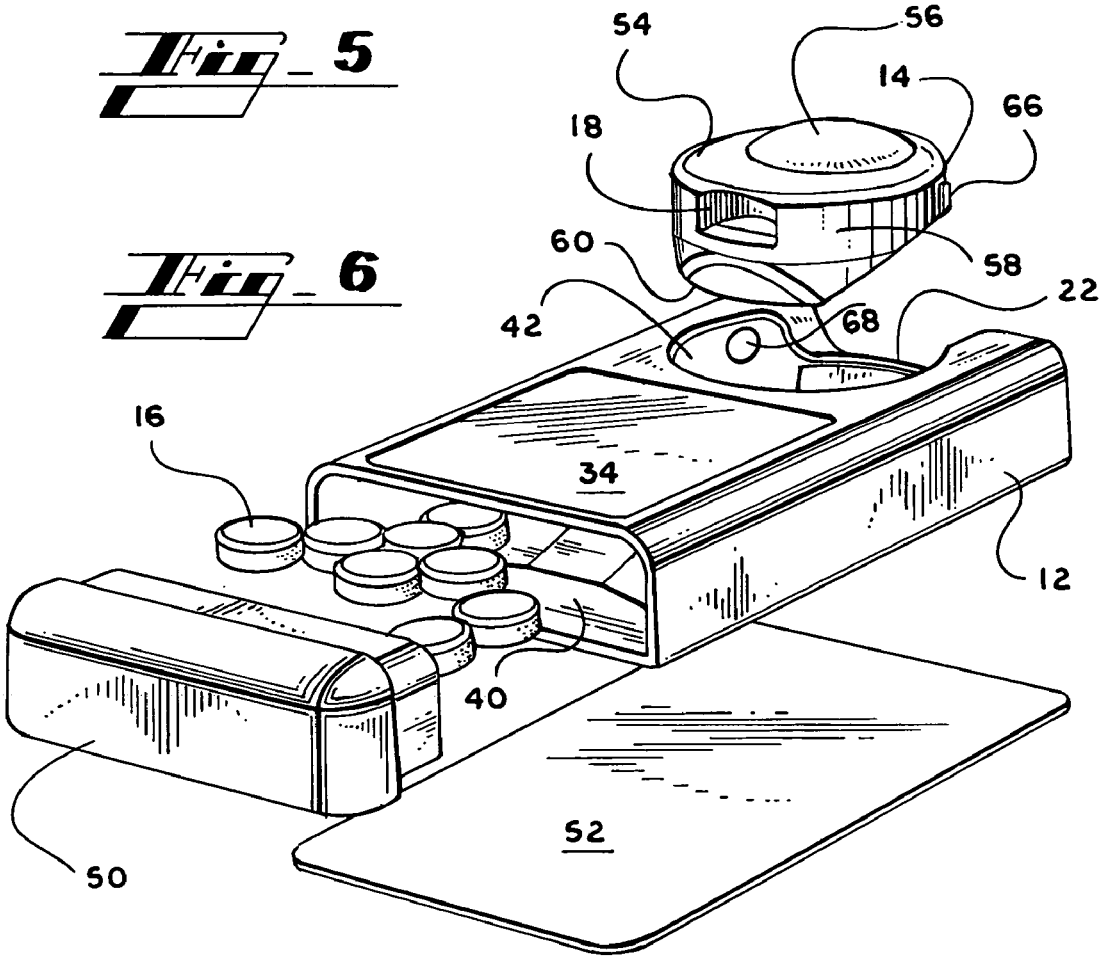

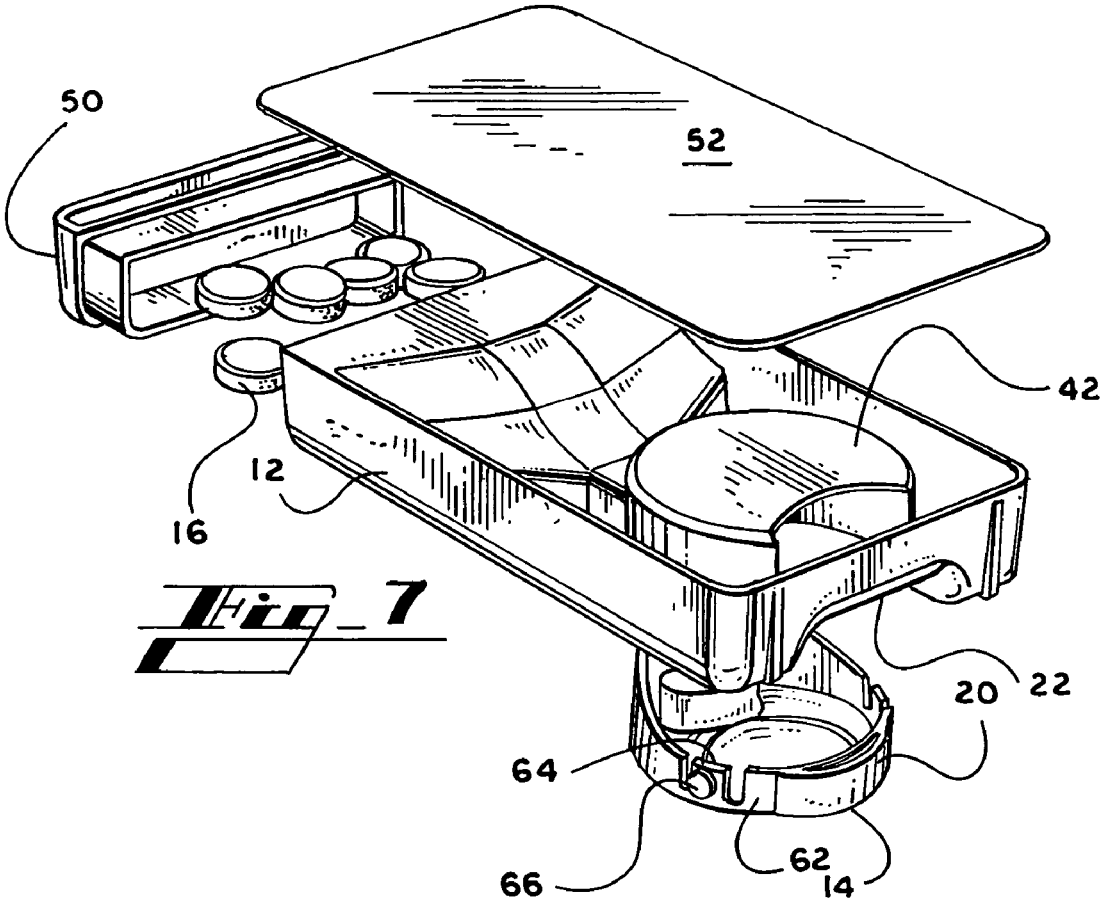
Fig_7
Fig_8
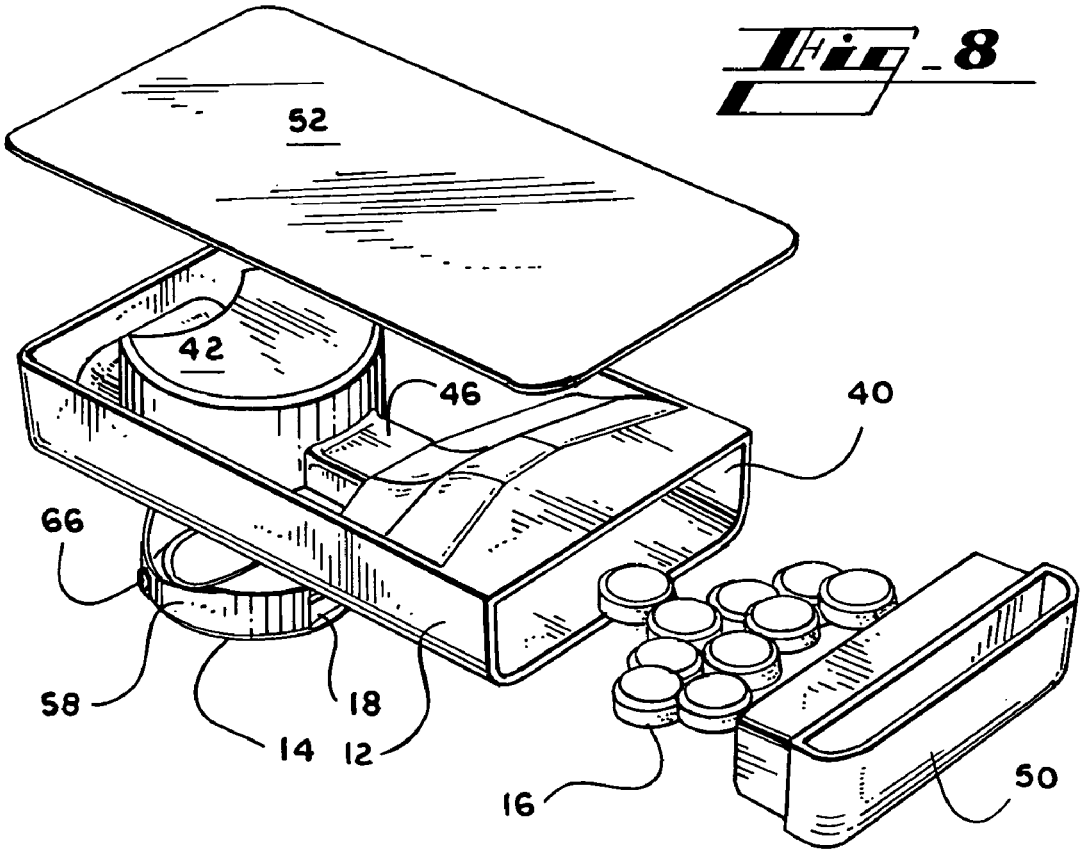

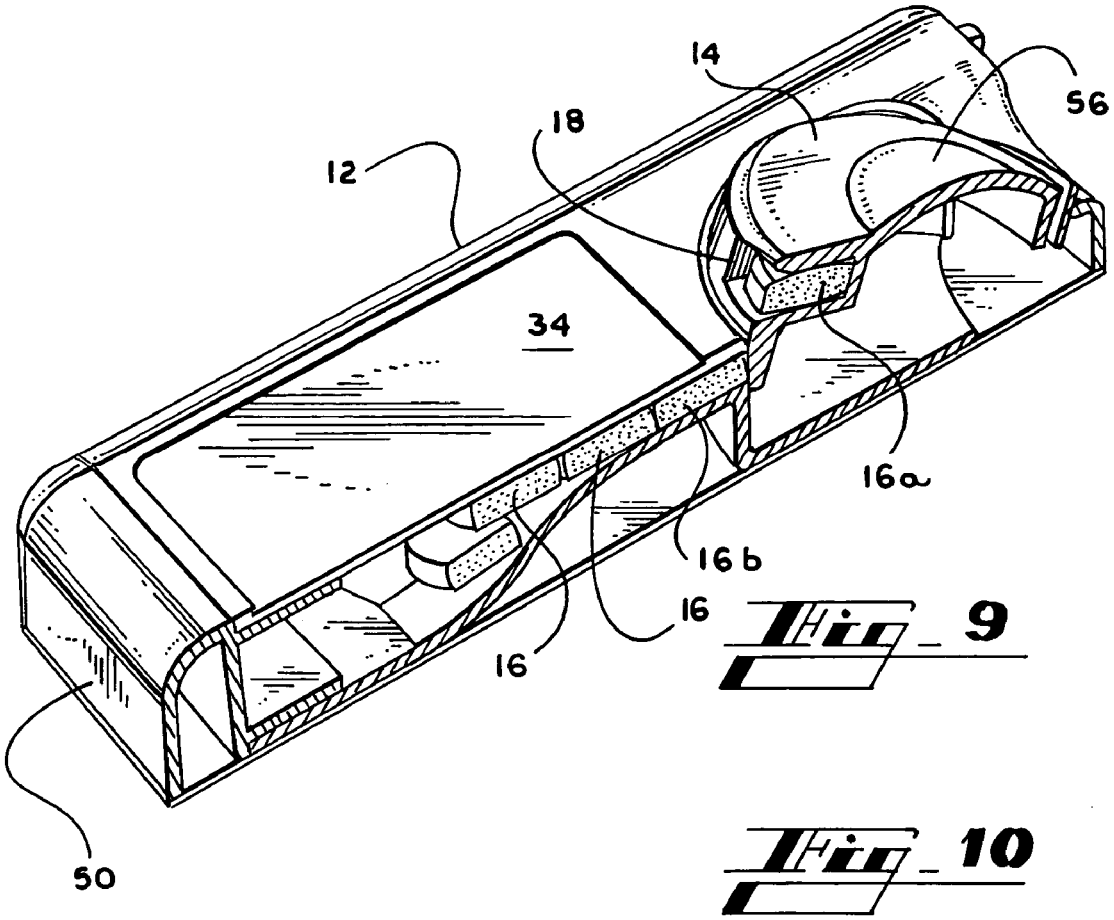
Fig. 9
Fig. 10
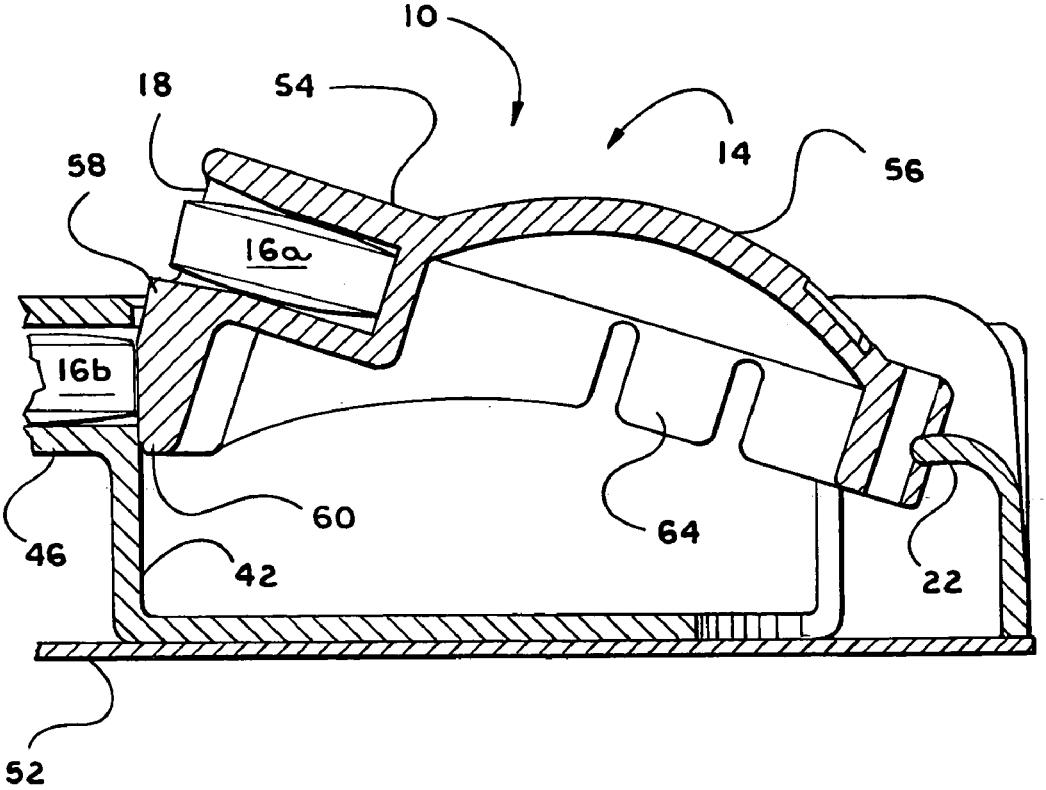

CHILD-RESISTANT PILL DISPENSER

CROSS-REFERENCE TO RELATED APPLICATION

This application is a continuation of International Application No. PCT/US03/029237, filed Sep. 19, 2003, which claims priority to U.S. Provisional Application No. 60/412,512 filed Sep. 20, 2002. The aforementioned applications are herein incorporated by reference.

FIELD OF THE INVENTION

The present invention relates generally to an apparatus and a method of packaging and dispensing a product, and more specifically, the present invention is directed to a child-resistant pill dispenser for dispensing pills and a method of packaging pills therein.

BACKGROUND OF THE INVENTION

Various bottles and other pill containers have been developed to include a variety of security features making it difficult for a child to open. For example, pills are commonly packaged in a bottle having a cap that can only be removed by pressing down on the cap while twisting it. However, this type of bottle has a number of disadvantages. First, if a child manages to open the bottle, the child has immediate access to the entire contents of the bottle. Second, if an adult user of the bottle fails to properly close the bottle after opening it, the security feature may be completely defeated. Third, a child-proof cap typically provides only a single line of security. If there is a structural failure of the locking cap, no other mechanism is typically provided to prevent a child from gaining access to the contents of the bottle.

According, there remains in the art a need for an apparatus and method for packaging and dispensing a product that provides easy access for the intended user, such as an adult, while providing a high degree of security against the unintended user, such as a child.

SUMMARY OF THE INVENTION

The present invention overcomes the deficiencies of the known art and the problems that remain unsolved by providing a child-resistant pill dispenser comprising a pill conveyor including a locking mechanism wherein pressure must be exerted to both the pill conveyor and the locking mechanism in order to pivot the pill conveyor open so as to gain access to at least one pill from the pill dispenser. The child-resistant pill dispenser includes security features which mandate the necessary coordination and combination of simultaneous actions by a user to open the pill dispenser.

In accordance with one embodiment of the present invention, there is provided a dispenser for dispensing pills comprising a chassis including a reservoir for holding pills, a pill conveyor pivotably mounted within the chassis, where the pill conveyor includes a pocket for receiving at least one pill, a pathway positioned between the reservoir and the pocket where the pathway includes a chute for holding at least one pill, the chute correspondingly aligned with the pocket for guiding said at least one pill into the pocket and a locking mechanism for releasably locking the pill conveyor in a closed position. Advantageously, the locking mechanism may comprise a resiliently deformable strap that is affixed to a rear plate of the pill conveyor where the strap butts up against a ledge on the chassis to hold the pill conveyor in a closed position.

Regarding the embodiments described herein, as well as those covered by the claims, the child-resistant pill dispenser may include other locking mechanisms without departing from the scope of the claims. In addition, the child-resistant pill dispenser may or may not include indicia or indicators, such as, an arrow or directives, for indicating to a user where a user should apply pressure to the pill conveyor in order to open the pill conveyor. Advantageously, the child-resistant pill dispenser may further include a pair of ridges for supporting the dispenser in an upright position and a panel for receiving a label containing product information, directions for use, text, graphics, or other printed material. In addition, the child-resistant dispenser may or may not be transparent.

In another embodiment of the present invention, there is provided a method for packaging pills in a child-resistant dispenser, the method comprising the steps of pivotably mounting a pill conveyor to a chassis where the pill conveyor includes a pocket for holding at least one pill, configuring a pathway between a reservoir and the pocket, where the pathway includes a chute for holding at least one pill where the chute is correspondingly aligned with the pocket for guiding at least one pill into the pocket, loading a plurality of pills into the reservoir, attaching an end cap to the chassis for securely holding the plurality of pills within the reservoir, attaching a bottom plate to the chassis and releasably locking the pill conveyor in a closed position. Regarding the embodiments described herein, as well as those covered by the claims, the plurality of pills are either manually loaded or automatically loaded into the reservoir of the chassis. The child-resistant pill dispenser may be loaded at the place of manufacture, by the user at home, or at any location by a health care professional. The end cap may be permanently or releasably attached to the chassis defining whether the child-resistant pill dispenser will be either reusable or disposable.

In a further embodiment of the present invention, there is provided a method of dispensing a pill from a child-resistant dispenser comprising the steps of sealing a plurality of pills within a reservoir of a chassis, guiding a pill from the reservoir of the chassis into a pocket of a pill conveyor where the pill conveyor is pivotably mounted to the chassis, unlocking the pill conveyor by applying pressure to a resiliently deformable strap affixed to the pill conveyor, where the pressure causes the resiliently deformable strap to flatten against a rear plate of the pill conveyor away from a ledge of the chassis, pivoting the pill conveyor from a closed position in which the pocket is inaccessible from outside the dispenser to an open position in which the pocket is accessible from outside the dispenser, and removing at least one pill from the pocket of the pill conveyor. Advantageously, the step of unlocking the pill conveyor further includes applying pressure to the pill conveyor to cause a second pill protruding within the pocket to move away from the pocket.

BRIEF DESCRIPTION OF THE DRAWINGS

FIGS. 1–3 are perspective views of an embodiment of the present invention.

FIG. 4 is a top transparent view of the embodiment shown in FIG. 1.

FIG. 5 is a cross-sectional view of an embodiment of the present invention.

FIGS. 6–8 are exploded views of embodiments of the present invention.

FIGS. 9–10 are cross-sectional views of embodiments of the present invention.

DETAILED DESCRIPTION

As required, detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular components. In other instances, well-known materials or methods have not been described in detail in order to avoid obscuring the present invention. Therefore, specific structural and functional details disclosed herein are not limiting but serve as a basis for the claims and for teaching one skilled in the art to variously employ the present invention.

Further, it will be understood that the present invention is taught in terms of a pill dispenser, but the invention is applicable to the packaging, storing, and dispensing of various items or products. Accordingly, the term "pill" as used herein includes all manner of small and portable items or products that a user may wish to keep secure and dispense in a regulated manner.

Figure 1:
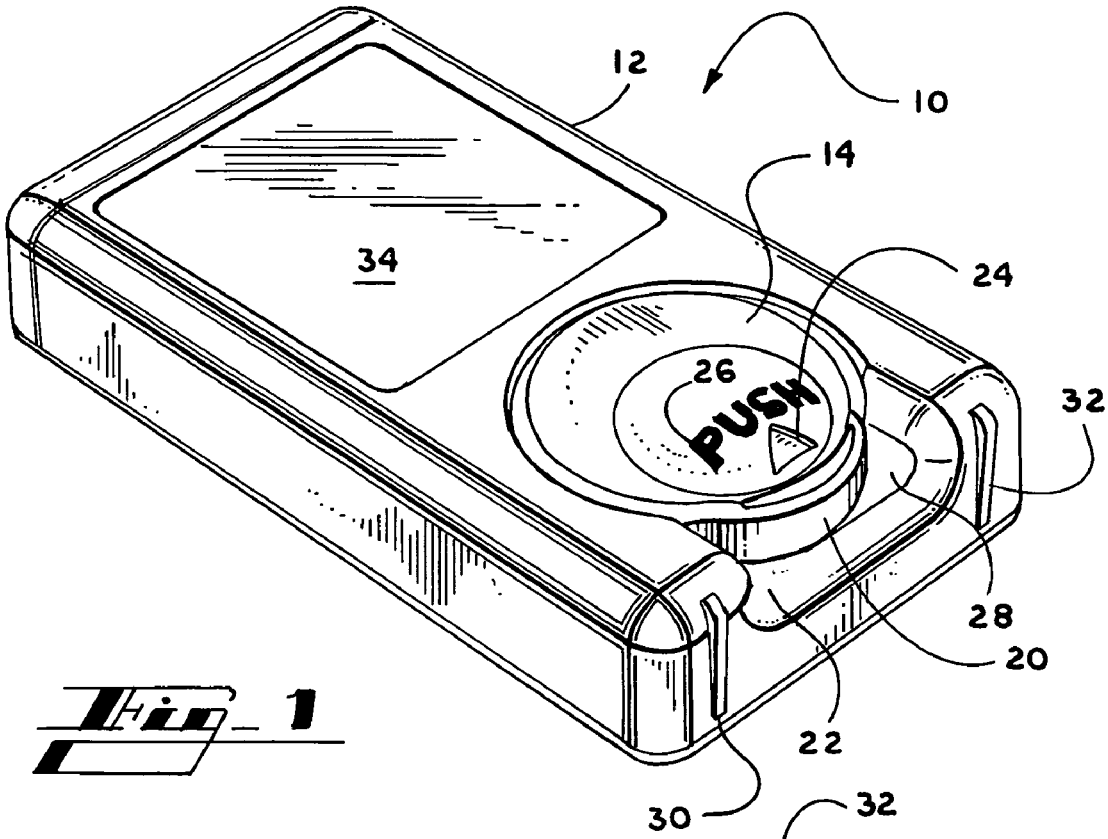
Figure 2:
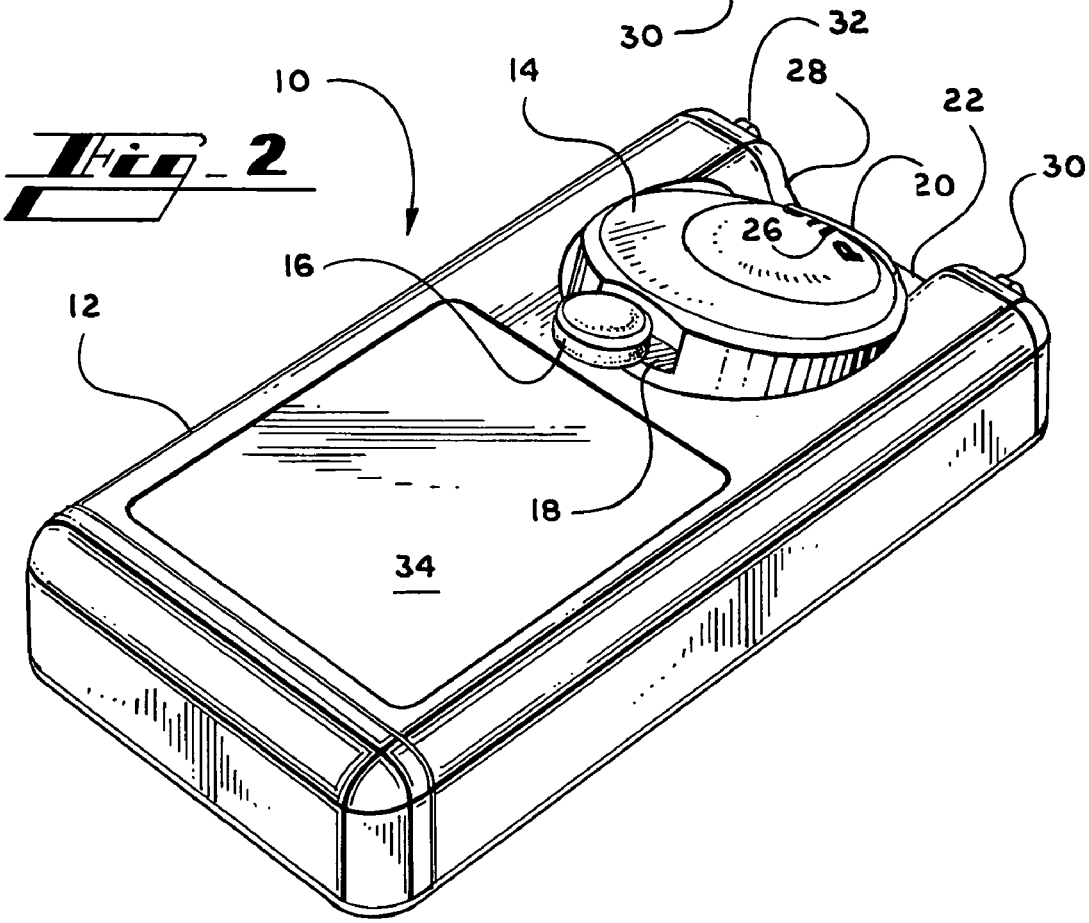

Referring now to the drawings, wherein like elements are represented by like numerals, FIGS. 1–3 show perspective views of a child-resistant pill dispenser 10 according to a first embodiment of the present invention. The pill dispenser 10 includes a chassis 12. Although the chassis 12 is shown as a substantially rectangular profile, it will be noted that the shape and size of the chassis 12 is merely a design choice. The pill dispenser 10 further includes a pill conveyor 14, generally referred to as a "coin", which is mounted within chassis 12. The pill conveyor 14 includes a pill conveyor pocket 18 dimensioned to receive at least one pill 16.

The pill conveyor 14 is pivotable between a first, closed position and a second, open position. As illustrated in FIGS. 2 and 3, the pill conveyor 14 is pivoted to an open position in order to release at least one pill 16 from the pill dispenser 10. The pill conveyor pocket 18 is accessible from the outside of the dispenser 10 only when the pill conveyor 14 is in an open position. When the pill conveyor 14 is in a closed position, the pill conveyor pocket 18 is enclosed within the dispenser 10, thus, making the pill conveyor pocket 18 inaccessible from the outside of the dispenser 10.

The pill conveyor 14 further includes a locking mechanism which releasably locks the pill conveyor 14 in a closed position. According to one embodiment of the present invention, the locking mechanism includes a resiliently deformable latching strap 20 that is affixed to a rear plate 62 of the pill conveyor 14, best illustrated in FIG. 7 below. When the pill conveyor 14 is closed in a resting position, the latching strap 20 bows outward and overhangs ledge 22 of chassis 12 so as to prevent the pill conveyor 14 from pivoting in an open position.

In the illustrated embodiments the pill conveyor 14 is unlocked by applying sufficient pressure to the latching strap 20 to cause the latching strap 20 to flatten against the rear wall of pill conveyor 14. Once flattened, the latching strap 20 clears ledge 22, allowing pill conveyor 14 to pivot in an open position. In one embodiment of the present invention, the latching strap 20 is recessed in a hollowed-out portion 28 of chassis 12. The hollowed-out portion 28 receives latching strap 20 and protects the latching strap 20 from damage, or from being accidentally unlocked.

The deformable latching strap 20 is a means for locking as are all selectively moveable structural configurations that prohibit the movement of the pill conveyor 14, such as but not limited to pins, latches, spring loaded stops, catches, nubs, interfacing protrusions and depressions, and the like as well as parts thereof. Further means for locking may be provided through additional or alternative security features, such as, adding structural elements to the dispenser 10 requiring additional steps be taken before being able to unlock the pill conveyor 14 and gaining access to at least one pill 16. One example of such means for locking includes modifying the dispenser 10 so that the pill conveyor 14 must be first rotated in a particular orientation before the pill conveyor 14 can be pivoted upward from chassis 12 of pill dispenser 10.

The dispenser 10 may further include indicators or indicia, such as, an arrow 24 which may be formed within or on pill conveyor 14 for indicating to a user what location and/or direction a user should apply pressure on the pill conveyor 14 so as to open the pill conveyor 14. One non-limiting example of indicia 26 may include the word "PUSH", which may be formed on or attached to pill conveyor 14.

Dispenser 10 may further include a pair of ridges 30 and 32 that are shaped to allow the dispenser 10 to stand on end. This feature could be used, for example, in a counter display or to store the dispenser in an upright position in a medicine cabinet. It will be noted that ridges 30, 32 may be manufactured in any suitable size and shape, the configuration being merely a design choice.

As illustrated in FIGS. 1–3, the dispenser 10 may further include a panel 34 that can be used to receive a stick-on label containing product information, directions for use, text, graphics, or other printed material. The panel 34 may be opaque or transparent thereby allowing a user to view the contents of the dispenser 10. It will be understood that other portions of the dispenser 10 may also be made transparent, or the entire dispenser 10 may be made transparent, if desired.

Referring to FIGS. 4 and 5, there is shown a top transparent view and a cross-sectional view of dispenser 10, respectively. FIGS. 4 and 5 illustrate how pills 16 are loaded into the pill conveyor pocket 18 of pill conveyor 14. As shown, chassis 12 includes a pill reservoir 40 for holding pills 16. The pill conveyor 14 is pivotably mounted into a compartment 42 of chassis 12. The dispenser 10 includes a number of interior surfaces 44 that together define a pathway between the pill reservoir 40 and the pill conveyor pocket 18. The pathway comprises a generally funnel-like shape, ending in a straight chute 46 leading to the pill conveyor pocket 18. The chute 46 is dimensioned to receive and hold at least one pill 16*b*.

With regard to operation of the illustrated embodiment, when the pill conveyor 14 is in a closed position a first pill 16*a* is loaded into the pill conveyor pocket 18 and a second pill 16*b* is subsequently guided into chute 46 via the pathway. As will be described below in reference to FIGS. 9–10, the second pill 16*b* in chute 46 cooperates with the first pill 16*a* in the pill conveyor pocket 18 to provide additional security. Individual pills 16 contained within the dispenser 10 are extracted, one at a time, from dispenser 10, by tilting the dispenser 10, when the pill conveyor 14 is in a closed position, causing a pill 16*a* to be loaded into pill conveyor pocket 18 of the pill conveyor 14. A gentle shaking of dispenser 10 may help to load pill 16*a* into the pill conveyor pocket 18. It will be seen that the same actions used to load a first pill 16*a* into the pill conveyor pocket 18 will also cause a second pill 16*b* to be guided into chute 46 and butt-up against pill 16*a*.

A user may unlock the pill conveyor 14 in order to gain access to a pill 16*a* by applying pressure to both the latching strap 20, to cause the latching strap 20 to flatten against the rear plate 62 of the pill conveyor 14, and to the pill conveyor 14 generally in the location of the arrow 24, thereby permitting the latching strap 20 to clear ledge 22 and rest in the hollowed-out portion 28 of dispenser 10. The pill conveyor 14 is subsequently pivoted in an open position, causing the pill conveyor pocket 18 to be exposed to the exterior of the dispenser 10 and allowing the user to remove pill 16*a* from the pill conveyor pocket 18. If a user wishes to extract another pill 16 from the dispenser 10, the user must pivot the pill conveyor 14 back in a closed position, reload the pill conveyor pocket 18 with a pill 16*a*, and again unlock the pill conveyor 14 by applying pressure to both the latching strap 20 and the pill conveyor 14.

FIGS. 6–8 are a series of exploded views of dispenser 10, showing the various components used to construct the illustrated embodiment. According to one aspect of the present invention, dispenser 10 includes a chassis 12, a pill conveyor 14, an end cap 50, and a bottom plate 52. The chassis 12, pill conveyor 14, and end cap 50 may be, but are not necessarily, fabricated using an injection molding technique and the bottom plate 52 may be trimmed from a larger sheet of plastic. If desired, some or all of the components of the dispenser 10 can be designed so that they snap and lock securely to each other without the need for additional fastening. Alternatively, a suitable adhesive or welding technique may be used to attach the components to each other. As understood by those skilled in the art, the pill dispenser 10 may be a single-use disposable unit or may be designed for multiple uses.

As shown in FIG. 6, chassis 12 is formed such that the pill reservoir 40 is open at the rear of the dispenser 10 allowing pills 16 to be quickly loaded into the pill reservoir 40. The loading operation may be performed by hand, or by machine. Once a desired number of pills 16 have been loaded into reservoir 40, the end cap 50 is subsequently attached to the chassis 12 in order to seal the pills 16 inside the reservoir 40. As mentioned above, the end cap 50 and the chassis 12 may be designed so that the end cap 50 releaseably snaps into position. Alternatively, the end cap 50 may be permanently attached by a suitable adhesive or welding technique.

According to an alternative embodiment of the present invention, the pill dispenser 10 is provided to a pharmacy with the end cap 50 not yet attached to the chassis 12. A pharmacist may load the pills 16 within the dispenser 10 at the pharmacy, and then snap the end cap 50 to chassis 12 and into place sealing the pills 16 inside the dispenser 10. Prescription information may be printed onto a stick-on label that is affixed to the square panel 34, or some other suitable location on or within the dispenser 10.

The pill conveyor 14 further includes a cover plate 54. In the illustrated embodiments the cover plate 54 is disc-shaped; however, other shapes may be used without departing from the scope of the claims. Further, a gripping surface, here shown as a dome 56, is formed on the cover plate 54. The dome 56 provides a gripping surface that may be used to hold the pill conveyor 14 in an open position. The dome 56 generally provides some indication of where to apply the necessary pressure on the pill conveyor 14 for pivoting the pill conveyor 14 to an open position. As with other exterior characteristics of the present invention, the gripping surface is not limited to a particular design choice.

Extending downward from cover plate 54 is a face plate 58. The pill pocket 18 is formed within face plate 58. The face plate 58 is dimensioned such that its bottom edge 60 rests on the bottom of the conveyor compartment 42 when the pill conveyor 14 is in a closed position. This arrangement prevents the pill conveyor 14 from being pivoted in the wrong direction. In addition the face plate 58 serves to block chute 46, connecting the pill reservoir 40 and the pill conveyor pocket 18, when the pill conveyor 14 is in an open position.

As illustrated in FIG. 7, the pill conveyor 14 further includes a rear plate 62 extending downward from the cover plate 54. As described earlier, here the latching strap 20 is affixed to the rear plate 62. The pill conveyor 14 further includes a pair of ears 64 on which are formed nubs 66 that lock into receiving apertures 68 disposed within the conveyor compartment 42. As shown, the pair of ears 64 are positioned between the face plate 58 and the rear wall 62 and the nubs 66 serve as pivot points for the pill conveyor 14. The latching strap 20 may be located at various positions proximate to or integral to the conveyor 14. Further, part or all of the pill conveyor 14 itself may be made resiliently deformable, while being sufficiently rigid to prevent failure of the security function, thereby functioning of and by itself as a means for locking.

As shown in FIGS. 7 and 8, the bottom side of the chassis 12 is irregularly shaped. Accordingly, a bottom plate 52 may be attached to cover the bottom side of the chassis 12. In addition to giving the bottom side of the assembled dispenser 10 a finished appearance, the bottom plate 52 may serve to prevent a child from gaining access to the underside of the pill conveyor 14 and possibly interfering with the security function.

Referring to FIGS. 9 and 10 there are shown cross-sectional views of dispenser 10, illustrating the operation of one embodiment of the present invention. As shown, pills 16 are guided within a pathway and travel along chute 46 to pill conveyor pocket 18. The pill conveyor pocket 18 is shaped and sized to hold a single pill 16*a*. If desired, the pill conveyor pocket 18 may be modified to hold two or more pills 16 without departing from the scope of the claims.

According to an embodiment of the present invention, the pill conveyor pocket 18 is dimensioned to be slightly deeper than the diameter of a pill 16. Thus, after a first pill 16*a* has been loaded into the pill conveyor pocket 18, a second pill 16*b*, which has entered chute 46, will protrude slightly into the pill conveyor pocket 18. The portion of the second pill 16*b* protruding into the pill conveyor pocket 18 makes it difficult to pivot the pill conveyor 14, even when the latching strap 20 has been pushed clear of ledge 22 of dispenser 10. To overcome this difficulty, pressure must also be applied to the pill conveyor 14. Applying pressure to the pill conveyor 14, causes the front face 58 of the pill conveyor 14 to deform slightly, thereby securing pill 16*a* within the pill conveyor pocket 18 and pushing pill 16*b* back in chute 46 and out of the way, thus, allowing the pill conveyor 14 to be pivoted in an open position. Even if the security feature of the latching strap 20 fails, it can be seen that it is difficult for a child to extract a pill 16 from the dispenser 10, because the child must also exert pressure on the pill conveyor 14 in order to push pill 16*b* back in the chute 46 and out of the way to allow the pill conveyor 14 to open.

Figure 11:
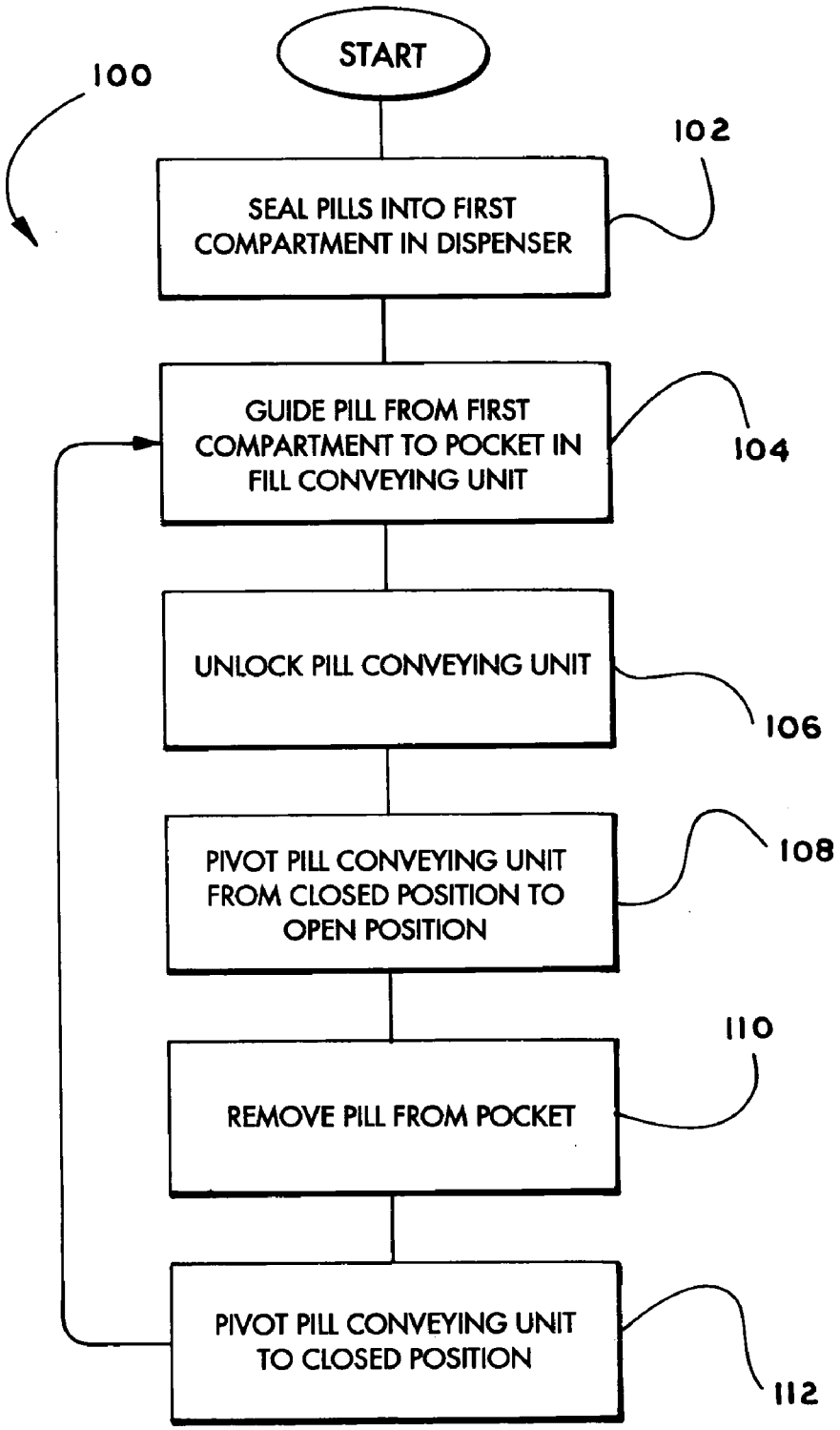
FIG. 11 is a flowchart of a method for dispensing pills from the pill dispenser according to an embodiment of the present invention.

Referring now to FIG. 11, there is shown a flowchart 100 illustrating one method of dispensing pills 16 from the child-resistant dispenser 10 according to an embodiment of the present invention. In step 102, pills 16 are loaded and sealed within the pill compartment 40 of the dispenser 10. Step 102 may be performed at a manufacturing facility, at home by the user, or at any location by a health care professional. Further, sealing comprising both permanent and temporary closing of the pill compartment. In step 104, a pill 16*a* is guided to enter chute 46 and is loaded within the pill conveyor pocket 18 while the pill conveyor 14 is in a closed position. In step 106, the pill conveyor 14 is unlocked. The pill conveyor 14 is locked using a means for locking, which in the illustrated embodiments comprises a deformable latching strap 20 that engages a ledge 22. As described earlier, the pill conveyor 14 is unlocked by applying pressure against the latching strap 20, however, because an additional locking feature is provided by a second pill 16*b* protruding into pill conveyor pocket 18, additional pressure must also be applied to the pill conveyor 14 in order to push the second pill 16*b* back in chute 46 and out of the way. After completing step 106, the pill conveyor 14, as illustrated in step 108, is pivoted upward from a closed position to an open position. In step 110, the pill 16*a* is removed from the pill conveyor pocket 18 of the dispenser 10. In step 112, the pill conveyor 14 is pivoted to a closed position, which subsequently causes the pill conveyor 14 to re-lock due to the resilient latching strap 20 protruding outwards and overhanging ledge 22 of the dispenser 10. Steps 104–112 are repeated, as necessary, to extract additional pills 16.

It will be seen that the pill dispenser 10 has a number of aspects that make it difficult for a child to gain access to the packaged pills 16. First, the child must maneuver a pill 16 into a pill conveyor pocket 18, which requires a certain amount of coordination. Then, the child must maintain the position of the pill 16*a* in the pill conveyor pocket 18 while attempting to unlock the pill conveyor 14. Unlocking the pill conveyor 14 requires manipulating the means for locking, maintaining that position while also applying pressure on the pill conveyor 14, and then pivoting the pill conveyor 14 to an open position all while taking care to make sure that the pill 16*a* continues to be held in the pill conveyor pocket 18. If a child somehow manages to release a pill 16, the child must re-lock the pill conveyor 14 and repeat steps 104–112, as illustrated in FIG. 11 in order to release a second pill 16. Thus, accidental access to pills 16 in the dispenser 10 is limited to one pill at a time, and not the entire contents of the dispenser 10. Even if a child somehow can repeat the skills required to remove a pill 16 from the dispenser 16, the time and effort required for a child to remove multiple pills 16 from the dispenser 10 may increase the probability that an adult will notice what the child is doing and timely intervene. Also, a child may become bored or frustrated and give up before removing too many pills 16 from the dispenser 10.

If the means for locking fails to operate, the dispenser 10 includes a fallback protection feature which is provided by the use of a deformable pill conveyor 14. As described above, in addition to applying pressure to the latching strap 20 so as to release the pill conveyor 14 from ledge 22, additional pressure must also be applied to the pill conveyor 14 in order to cause the front face of the pill conveyor 14 to deform and push a second pill 16*b* in the chute 46 away from the pill conveyor pocket 18. Also, if an adult accidentally leaves the dispenser 10 open, or fails to close the dispenser 10 properly, a child will have to complete the necessary steps 102–112, as illustrated above, thus, making it very difficult for a child to gain access to a pill 16.

It must be emphasized that the law does not require and it is economically prohibitive to illustrate and teach every possible embodiment of the present claims. Hence, the above-described embodiments are merely exemplary illustrations of implementations set forth for a clear understanding of the principles of the invention. Many variations and modifications may be made to the above-described embodiments without departing from the scope of the claims. All such modifications, combinations, and variations are included herein by the scope of this disclosure and the following claims.

I claim:

1. A system for dispensing, comprising:

a chassis having a closed surface including a reservoir for holding items and a pathway extending from the reservoir including a chute for holding and guiding at least one item; and an item conveyor including a pocket for receiving at least one item mounted within said chassis adjacent said chute pivotable between a first, closed position wherein said chute and said pocket are aligned with one another and wherein said pocket is not accessible exteriorly of said chassis, and a second, open position wherein said closed surface is breached to expose said pocket at an acute angle with respect to said chute.

2. The system of claim 1, wherein said chassis further includes at least one interior surface defining said pathway, said pathway being funnel-shaped and terminating into said chute.

3. The system of claim 1, wherein said item conveyor includes a cover plate and a face plate extending downward from said cover plate, said pocket being formed within the face plate.

4. The system of claim 3, wherein said face plate blocks the pathway between the reservoir and the pocket when said item conveyor is in said second, open position.

5. The system of claim 3, wherein the item conveyor further includes a pair of ears extending downward from said cover plate, and wherein there is formed on each ear a nub that fits into a receiving aperture in the chassis such that said item conveyor pivots around said nubs.

6. The system of claim 3, further comprising a locking mechanism for releasably locking said item conveyor in said first, closed position including a rear plate extending downward from the cover plate, and a resiliently deformable strap affixed to said rear plate, said strap butting up against a ledge on the chassis to hold said item conveyor in a said first, closed position.

7. The system of claim 6, wherein said strap bows outward, away from the rear plate, and wherein applying pressure to the strap causes the strap to flatten against the rear plate away from said ledge.

8. The system of claim 1, wherein the pocket is dimensioned to be deeper than one item so that when said at least one item is loaded in said pocket, an item in said chute protrudes into said pocket.

9. The system of claim 8, wherein the item conveyor is fabricated from a resiliently deformable material, such that when pressure is applied to said item conveyor, the at least one item in said pocket pushes the at least one item in the chute away from said pocket.

10. The system of claim 1, wherein said item conveyor further includes indicia for indicating a location of where to apply pressure to said item conveyor for opening said item conveyor.

11. The system of claim 1 further including a panel for receiving a label containing product information, directions for use, text, graphics, or other printed material, said panel being opaque or transparent.

12. A method for packaging items in a child-resistant dispenser, said method comprising the steps of: pivotably mounting an item conveyor to a chassis, said item conveyor including a pocket for holding at least one item; configuring a pathway between a reservoir and said pocket where said pathway includes a chute for holding at least one item, said chute correspondingly aligned with said pocket for guiding said at least one item into said pocket loading a plurality of items into said reservoir; attaching an end cap to said chassis for securely holding said plurality of items within said reservoir; attaching a bottom plate to said chassis; and releasably locking said item conveyor in a closed position.

13. A method of claim 12, wherein said pivotably mounting an item conveyor to said chassis includes the step of forming a cover plate and a face plate extending downward from said cover plate.

14. A method of claim 13, further including the step of including a pair of ears extending downward from said cover plate, and disposing a nub on each ear, each nub fitting into a corresponding aperture in said chassis.

15. A method of claim 14, further including the step of including a rear plate extending downward from the cover plate and affixing a locking mechanism comprising a resiliently deformable strap to said rear plate.

16. A method of claim 15, further including the step of dimensioning said pocket to be deeper than one item so that when said at least one item is loaded in said pocket, an item in said chute protrudes into said pocket.

17. A method of claim 12, wherein said configuring a pathway between a reservoir and said pocket includes the step of including at least one interior surface defining said pathway, said pathway being funnel-shaped and terminating into said chute.

18. A method of claim 12, wherein said loading a plurality of items into said reservoir includes any one of manually loading a plurality of items into said reservoir and automatically loading a plurality of items into said reservoir.

19. A method of claim 12, wherein said attaching an end cap to said chassis includes any one of permanently attaching said end cap to said chassis and releasably attaching said end cap to said chassis.

20. A method of claim 12, wherein said releasably locking said item conveyor in a closed position includes the step of closing said item conveyor so that said resiliently deformable strap abuts against a ledge of said chassis.

21. A method of claim 12, further including the step of forming indicia on said item conveyor for indicating to a user where to apply pressure to said item conveyor.

22. A method of claim 12, further including the step of including a pair of ridges on said chassis for supporting said dispenser in an upright position.

23. A method of claim 12, further including the step of including a panel within said chassis, said panel being opaque or transparent and receiving any one of a label, information, directions, text, graphics, or other printed material.

24. A method of dispensing an item from a child-resistant dispenser comprising the steps of: sealing a plurality of items within a reservoir of a chassis guiding an item from said reservoir through a chute and into a pocket of an item conveyor, said item conveyor being pivotably mounted to said chassis; unlocking the item conveyor by applying pressure to a resiliently deformable strap affixed to said item conveyor, said pressure causing the resiliently deformable strap to flatten against a rear plate of said item conveyor away from a ledge of said chassis; pivoting the item conveyor from a closed position in which the pocket is inaccessible from outside the dispenser to an open position in which the pocket is accessible from outside the dispenser; and removing an item from the pocket of said item conveyor.

25. The method of claim 24, wherein the step of unlocking the item conveyor further includes applying pressure to the item conveyor to cause a second item protruding within said pocket to move back into the chute and away from said pocket.

26. The system of claim 1, further comprising a locking mechanism for releasably locking said item conveyor in said first, closed position.

27. The system of claim 1, wherein said item conveyor is pivotable by a reciprocating movement.

* * * * *